United States Patent [19]

Miline

[11] Patent Number: 4,576,613

[45] Date of Patent: Mar. 18, 1986

[54] PROCESS FOR CONFINING THE POLLUTION IN AN AREA

[75] Inventor: Francois Miline, Paris, France

[73] Assignee: Commissariat a l'Energie Atomique, Paris, France

[21] Appl. No.: 512,619

[22] Filed: Jul. 11, 1983

[30] Foreign Application Priority Data

Jul. 15, 1982 [FR] France ..... 82 12382

[51] Int. Cl.[4] ..... B61D 45/12

[52] U.S. Cl. ..... 55/1; 55/17; 55/385 A; 55/DIG. 29; 98/115.1; 376/31 D

[58] Field of Search ..... 55/1, 52, 55, 57, 17, 55/385 A, 385 R; 376/310-311; 98/36, 115 R

[56] References Cited

U.S. PATENT DOCUMENTS 2,593,702 4/1948 Schneible ..... 98/115

3,706,138 12/1972 Schuierer ..... 98/36 X

FOREIGN PATENT DOCUMENTS 3004073 8/1981 Fed. Rep. of Germany .

7123855 3/1982 France .

1237694 6/1971 United Kingdom .

*Primary Examiner*—Charles Hart

[57] ABSTRACT

The present invention relates to a process for confining the pollution in an area with the aid of a gaseous jet. The gaseous jet is formed by a transition zone and a full jet development zone, the transition zone having a dart. The latter is given a length equal to the range of the jet and the first gaseous jet is controlled by a second gaseous jet on the opposite side of the area compared with the first jet.

Application to the confinement of areas containing toxic or radioactive products.

4 Claims, 3 Drawing Figures

PROCESS FOR CONFINING THE POLLUTION IN AN AREA

BACKGROUND OF THE INVENTION

The present invention relates to processes for confining a polluted area with the aid of a gaseous jet and more specifically to a process making it possible to have a very high ratio between the pollution level of the area and the pollution level outside said area.

It is known, particularly in nuclear installations, to isolate an area containing a machine giving off large quantities of radioactive dust, by means of an air curtain, in order to be able to easily intervene on said machine through said air curtain. An example of the application of this process is illustrated in FIG. 1, in which it is possible to see within cell 1, a vertical partition 2 defining an area 4 within which is installed a machine 6 used for cutting up nuclear fuel elements. The area 4 containing the machine 6 is linked with the remainder of the cell by an opening 8. A divergent gaseous jet 12 passing out of a nozzle 10 covers the entire surface of the opening 8, thus preventing the polluted air of area 4 from entering the clean area 5 of cell 1. The air in jet 12 is taken up by a suction orifice 14 and is passed into a circuit comprising a cyclone 16 and a fan 18. Throughout the remainder of the present text the term "range of jet 12" will be used to define the distance covered by the latter from the injection slot 7 and extending up to the orifice 14 and which corresponds to the width of opening 8.

The air leaving cyclone 16 is generally discharged to the exterior of the enclosure 1. As it still contains a certain amount of radioactive dust, it must be filtered by means of an absolute filter 19 before being discharged into the atmosphere. However, quite apart from the fact that such filters are very expensive, their replacement is a long and difficult operation, due to all the protection required as a result of the high activity of the dust. Moreover, they represent active waste, which must be conditioned or processed prior to removal. It is therefore important to reduce the frequency with which replacement takes place. Thus, only part of the air leaving cyclone 16 is discharged to the outside, whilst the other part is recycled in nozzle 10. An opening 22 in wall 23 of cell 1 enables ventilation air to penetrate the cell, in order to replace the air extracted through filter 19 by fan 20.

Such a process has serious disadvantages. Thus, as can be seen in FIG. 1, the gaseous jet 12 is formed by two parts, namely a first part called the "transition zone" extends over a length 1 from slot 7 and consists of a "potential" core or "dart" 13, which is formed only by the air injected through nozzle 10 and which, viewed in section, is substantially shaped like a triangle of length 1, the latter being equal to approximately 6 times the width e of the injection slot. The velocity of the gas is the same at any point on dart 13 and is equal to the injection velocity. The second part of the gaseous jet 12 is a zone called "the full development of the jet zone" 15, in which the air injected through nozzle 10 is mixed, by suction, with the air present in cell 4 and in the clean area 5 of enclosure 1. The full development of the jet zone extends beyond the tip of the dart, specifically from the latter up to the suction orifice 14. As zone 15 has very turbulent operation conditions, it sucks in a large proportion of the dust contained in cell 4 (arrows 9). Beyond a certain concentration in jet 12, there is a risk of the dust being discharged into the clean area 5 of the enclosure by turbulent diffusion. In the most unfavourable case, the concentration of the pollution in area 5 can be roughly half its level in area 4 whereas, particularly in the nuclear industry, a minimum concentration ratio is required and this is generally below 1:100. Moreover, the dust activates the fixed installation in area 5 of cell 1 and the thus produced cumulative contamination can be very high after a certain time. In order to obviate this deficiency, attempts have been made to increase the velocity of the air blown in, but this leads to no improvement and only increases operating costs.

SUMMARY OF THE INVENTION

The object of the present invention is a process for the confinement of a polluted area by means of an air curtain, which obviates these disadvantages and makes it possible to considerably lower the pollution level outside the said area.

With respect to the main feature of the process according to the invention, in the case of the area communication with the outside by at least one opening, a gaseous jet is circulated level with said opening, the dimensions of this jet being such that it covers the entire surface of the opening. The gaseous jet has a transition zone and a full development of the jet zone, the transition zones having a potential core or dart. According to the invention the dart is given a length equal to the range of the jet and a second gaseous jet is circulated on the side opposite to the area with respect to the first, the second jet being adjacent to the first.

Thus, as the dart covers the entire surface of opening 8, there is no longer any risk of dust passing from the outside of the area and through the turbulent mixing zone. The function of the second gaseous jet is to stabilize the first. Thus, in order that the dart has a sufficient length, it is necessary for the injection slot width to be equal to approximately 1/6 of the distance between nozzle 10 and suction orifice 14. This imposes a low injection velocity (because if not the flow rate would be prohibitive), which risks making the jet unstable. The second gaseous jet produces a suction effect, which engages the first jet with the second and stabilizes it.

According to another feature of the process according to the invention, the injection flow rates of the two gaseous jets are adjusted in such a way that the air flow induced by the face of the second jet which is in contact with the first is substantially equal to the injection flow rate of the first jet.

Thus, the injection flow rate of the first jet is equal to the air flow which would have been sucked into the room, if there had only been the second jet. This prevents the first jet from deforming by deflection towards the lower wall of area 4. Thus, the second jet sucks the injection air of the first jet, mixed by turbulent diffusion with a small fraction of the polluted air of area 4 into the latter. In addition, it sucks in the clean air in area 5 of cell 1. Thus, the air discharged through the suction orifice 14 is only very slightly polluted, compared with the atmosphere of area 4.

According to another feature of the process according to the invention, there is partial recycling of the air of the two gaseous jets after it has been taken up by the suction orifice and is passed to a cleaning apparatus which can be e.g. a cyclone or a dripping tower. The energy necessary for circulating the air is supplied by a circulation apparatus, which can be a fan, a compressor, an air ejector, etc.

Finally, the invention also relates to an application of this process to the confinement of an area containing radioactive dust produced by the cutting up of nuclear fuel elements.

BRIEF DESCRIPTION OF THE DRAWINGS

The invention is described in greater detail hereinafter relative to non-limitative embodiments and with reference to the attached drawings, wherein show.

DETAILED DESCRIPTION OF THE INVENTION

Figure 2:
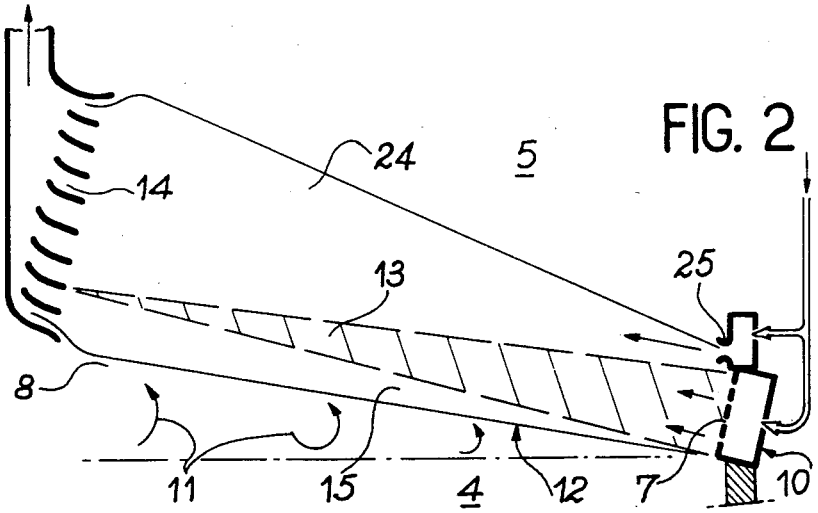
FIG. 2 a diagrammatic sectional view of the two gaseous jets used in the process according to the invention.

FIG. 2 shows that nozzle 10 has been transformed by giving injection slot 7 an adequate width for the end of the dart 13 of the first jet to be level with the suction orifice 14. According to the invention, the first jet 12 is controlled by means of a second gaseous jet 24, which enters via a nozzle 25, positioned in the immediate vicinity of nozzle 10. The flow rates are calculated in such a way that, from the side of cell 4, jet 24 sucks in an air flow equal to the injection flow of the first jet. As dart 13 covers the entire surface of opening 8 and consequently prevents dust from passing to the outside of area 4, the air sucked in by orifice 14 is only slightly polluted.

In actual fact, a small amount of the dust contained in cell 4 is discharged by orifice 14 for the following reason. The first gaseous jet 12 has a turbulent mixing zone 15 which sucks in the air from cell 4 and consequently a certain amount of the dust contained therein (arrows 11). Consequently part of this dust is extracted by orifice 14, whilst the other part is recycled into the cell 4 by the induced stream. However, the air sucked in by orifice 14 is much less polluted than in the case of the prior art process. It is then merely necessary to pass the air sucked in by orifice 14 to a cyclone in order to reduce its concentration and obtain a polluting dust concentration in part 5 of the cell, which is well below that of area 4.

Figure 1:
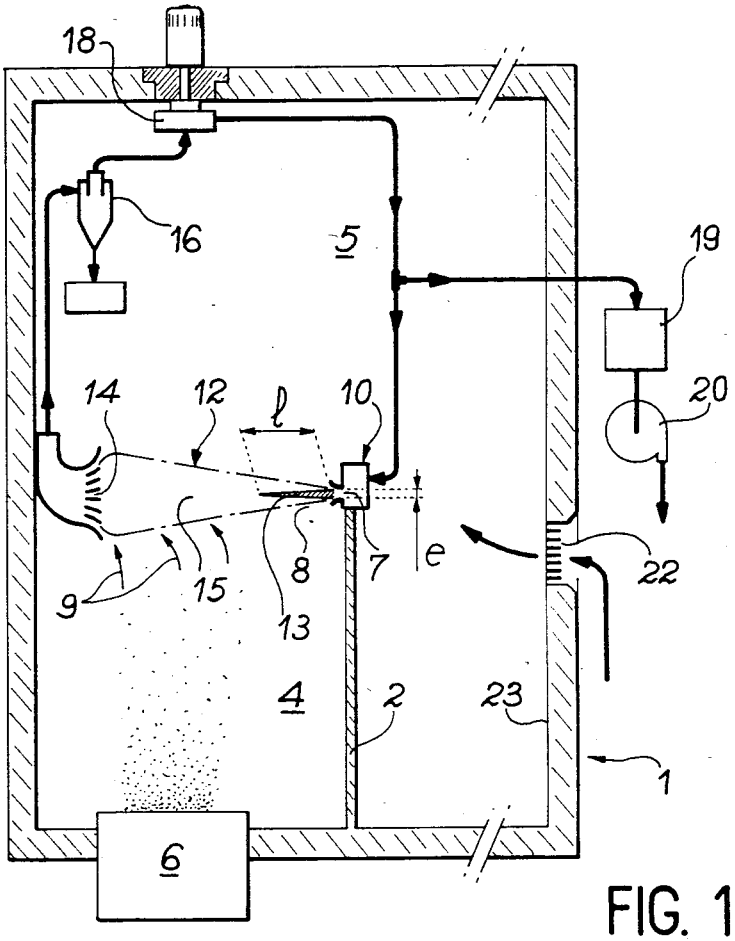
FIG. 1 already described, a diagrammatic view in section illustrating a prior art area confinement process.
Figure 3:
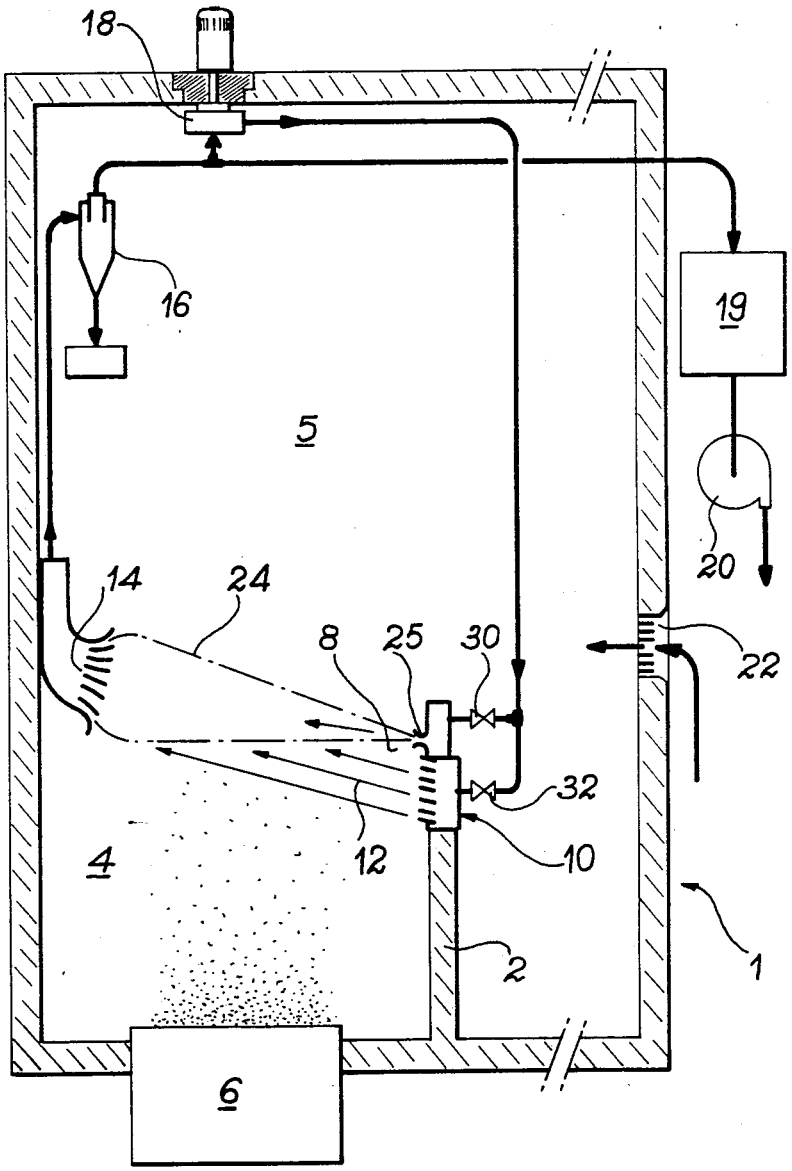
FIG. 3 a diagrammatic sectional view similar to FIG. 1 showing the application of the process of the invention to the same area.

FIG. 3 illustrates the application of the process according to the invention to the cell of FIG. 1. It is once again possible to see cell 1, equipped with partition 2 defining area 4 containing machine 6. This area is separated from the upper part 5 of the cell by a double air curtain, constituted by the first gaseous jet 12 leaving nozzle 10 and the second jet 24 leaving nozzle 25. The air sucked in by the suction orifice 14 is firstly passed to cyclone 16, which reduces its pollutant concentration. As in the case of FIG. 1, part of the air leaving cyclone 16 is discharged to the outside of cell 1 by means of fan 20, after passing over an absolute filter 19. Another part is recycled by means of fan 18. Another part of this recycled air is passed into nozzle 10 by means of a valve 32, whilst another part is passed into nozzle 25 via a valve 30.

In exemplified manner, the process according to the invention has been applied to a cell such as 1, containing a machine 6, used for cutting up nuclear fuel elements. The opening 8 separating area 4 from the upper area 5 of the cell has a length of 9 m and a width of 3 m. The distance between the outlet of nozzle 10 and the inlet of suction orifice 14 is 2.4 m. The total air flow rate entering the cell is 44,350 $m^3/h$, including 19,000 $m^3/h$ of fresh air entering the cell through opening 22 and 25,350 $m^3/h$ of recycled air. The latter is split up in such a way that 6350 $m^3/h$ passes through nozzle 25 to form the second rapid jet 24 and 19,000 $m^3/h$ passes through nozzle 10 to produce the first slow jet 12.

The external fan 20 and fan 18 ensure a total flow rate of 44,350 $m^3/h$ in suction orifice 14 and cyclone 16. Of this flow 25,350 $m^3/h$ comes from the two gaseous jets 12 and 24 and 19,000 $m^3/h$ consists of fresh air entering via opening 22. With the aforementioned flow values, the ratio between the radioactive dust concentrations in area 4 and area 5 of the cell is approximately 100, i.e. a value well above that obtainable with the prior art processes.

Moreover, other test series have demonstrated that it was possible to pass a manipulator arm through an air curtain according to the invention without significantly impairing the effectiveness of the confinement.

The process according to the invention has particularly interesting advantages, because it makes it possible to considerably induce the cumulative contamination outside area 4. Moreover, the dust concentration in the air passing through cyclone 16 and absolute filter 19 is reduced, which reduces the operating costs of the installation by increasing the service life of the filters.

The present process has numerous, varied applications, which are not limited to the nuclear industry. For example, in the chemical industry, it is possible in this way to isolate an area in which particularly toxic products are being handled. For example, in the case of installations producing chlorine, it is possible to use an alkaline solution dripping tower in place of the cyclone and filter for eliminating the chlorine. Finally, the process according to the invention can be applied to any installation producing large quantities of dust, no matter whether or not this dust is radioactive.

What is claimed is:

1. A process for the confinement of pollution of an area communicating with an external atmosphere through at least one opening, wherein a first gaseous jet is circulated along said opening, said gaseous jet covering the entire surface of said opening and being formed by a transition zone and a full jet development zone, the transition zone comprising a dart, said gaseous jet having a first side facing said area and a second side facing said external atmosphere, wherein the transition zone is given a length equal to the range of the jet and wherein a second gaseous jet is circulated along said second face of the first jet, in the same sense of direction, said second gaseous jet having a first side adjacent to the second side of the first jet and a second side facing said external atmosphere, the injection flow rate of the second jet being greater than the injection flow rate of the first jet and the air flow induced by the first side of the second jet being substantially equal to the injection flow rate of the first jet.

2. A process according to claim 1, wherein the air of the two gaseous jets is recycled after having been taken up by a suction orifice and passed on to a cleaning apparatus, the air being circulated by a circulating apparatus.

3. A process according to claim 2, wherein a cyclone is used as the cleaning apparatus.

4. An application of the process according to claim 1, to the confinement of an area containing radioactive dust produced by the cutting up of nuclear fuel elements.

* * * * *